US008571430B2

(12) United States Patent
Soda

(10) Patent No.: US 8,571,430 B2
(45) Date of Patent: Oct. 29, 2013

(54) WET-TYPE IMAGE FORMING APPARATUS

(75) Inventor: Tomohisa Soda, Osaka (JP)

(73) Assignee: Kyocera Mita Corporation (JP)

( * ) Notice: Subject to any disclaimer, the term of this patent is extended or adjusted under 35 U.S.C. 154(b) by 201 days.

(21) Appl. No.: 13/311,636

(22) Filed: Dec. 6, 2011

(65) Prior Publication Data

US 2012/0148279 A1 Jun. 14, 2012

(30) Foreign Application Priority Data

Dec. 14, 2010 (JP) ..... 2010-278257

(51) Int. Cl.
*G03G 15/10* (2006.01)

(52) U.S. Cl.
USPC ..... 399/57; 399/55; 399/237; 399/233

(58) Field of Classification Search
USPC ..... 399/57, 55, 233, 235, 348, 237
See application file for complete search history.

(56) References Cited

U.S. PATENT DOCUMENTS

2010/0040387 A1 2/2010 Hirai
2011/0217083 A1* 9/2011 Sasaki et al. ..... 399/249

FOREIGN PATENT DOCUMENTS

JP 2006-30719 2/2006
JP 2010-44189 2/2010

* cited by examiner

*Primary Examiner* — Walter L Lindsay, Jr.
*Assistant Examiner* — Roy Y Yi
(74) *Attorney, Agent, or Firm* — Gerald E. Hespos; Michael J. Porco; Matthew T. Hespos

(57) ABSTRACT

A wet-type image forming apparatus includes an image bearing member, a developer bearing member for bearing liquid developer containing toner and carrier liquid on the circumferential surface thereof, a bias applying unit for applying a developing bias to the developer bearing member, a first charging unit for charging the toner in the liquid developer to a first polarity before supplying the liquid developer to the image bearing member, and a second charging unit for reversely charging the toner in residual liquid developer remaining on the circumferential surface of the developer bearing member to a second polarity opposite to the first polarity after the development process. When $V_D$ denotes the developing bias and $V_0$ denotes the surface potential of the residual liquid developer when the reverse charging is not performed, a surface potential V of the residual liquid developer after reverse charging satisfies the equation:

$$0.1 \leq (V_D - V)/(V_0 - V_D) \leq 1.0.$$

7 Claims, 8 Drawing Sheets

WET-TYPE IMAGE FORMING APPARATUS

BACKGROUND OF THE INVENTION

1. Field of the Invention

The present disclosure relates to a wet-type image forming apparatus for forming an image using liquid developer containing toner and carrier liquid.

2. Description of the Related Art

A wet-type image forming apparatus for image formation using liquid developer can use toner having a small particle diameter since scattering of the toner is not problematic and, hence, has an advantage of forming a high-quality image. However, the specific surface area of the toner increases since the toner has a small particle diameter, wherefore the toner tends to be highly charged and adhesion to the surface of a developer bearing member such as a developing roller increases. As a result, a cleaning process of removing the liquid developer remaining on the surface of the developing roller after a development process becomes difficult.

Conventionally, several technologies for facilitating this cleaning process have been proposed. As a first conventional technology is known a wet-type image forming apparatus including a removal assisting unit for weakening cohesive force of toner particles in a liquid developer, the removal assisting unit being arranged upstream of a cleaning blade for removing residual liquid developer from the surface of a developing roller in a rotating direction of the developing roller. A charger or the like for applying an electric field having a polarity opposite to a charge polarity of the toner to neutralize the toner is used as this removal assisting unit. As a second conventional technology is known a wet-type image forming apparatus including a similar charge neutralizing unit for residual developer and a control unit for adjusting an output of the charge neutralizing unit according to an output of a charging unit for charging liquid developer.

However, in some cases, the residual developer could not be satisfactorily removed from the developing roller surface only by applying an electric field for charge neutralization to toner particles in liquid developer.

SUMMARY OF THE INVENTION

An object of the present disclosure is to provide a wet-type image forming apparatus capable of precisely removing residual developer remaining on the surface of a developer bearing member after a development process.

To achieve this object, one aspect of the present disclosure is directed to a wet-type image forming apparatus, including: an image bearing member for bearing an electrostatic latent image and a toner image on the circumferential surface thereof; a developer bearing member for bearing liquid developer containing toner and carrier liquid on the circumferential surface thereof and supplying the liquid developer to the image bearing member to develop the electrostatic latent image; a bias applying unit for applying a developing bias to the developer bearing member a first charging unit for charging the toner in the liquid developer to a first polarity before a development process of supplying the liquid developer to the image bearing member; a second charging unit for reversely charging the toner in residual liquid developer remaining on the circumferential surface of the developer bearing member to a second polarity opposite to the first polarity after the development process; and a removing unit for removing the residual liquid developer from the circumferential surface of the developer bearing member after charging to the second polarity.

A surface potential V of the residual liquid developer after the reverse charging satisfies the following equation (1) when VD denotes the developing bias and V0 denotes the surface potential of the residual liquid developer when the reverse charging is not performed:

$$0.1 \leq (V_D - V)/(V_0 - V_D) \leq 1.0 \quad (1).$$

These and other objects, features and advantages of the present disclosure will become more apparent upon reading the following detailed description along with the accompanying drawings.

DETAILED DESCRIPTION OF THE PREFERRED EMBODIMENTS

Figure 1:
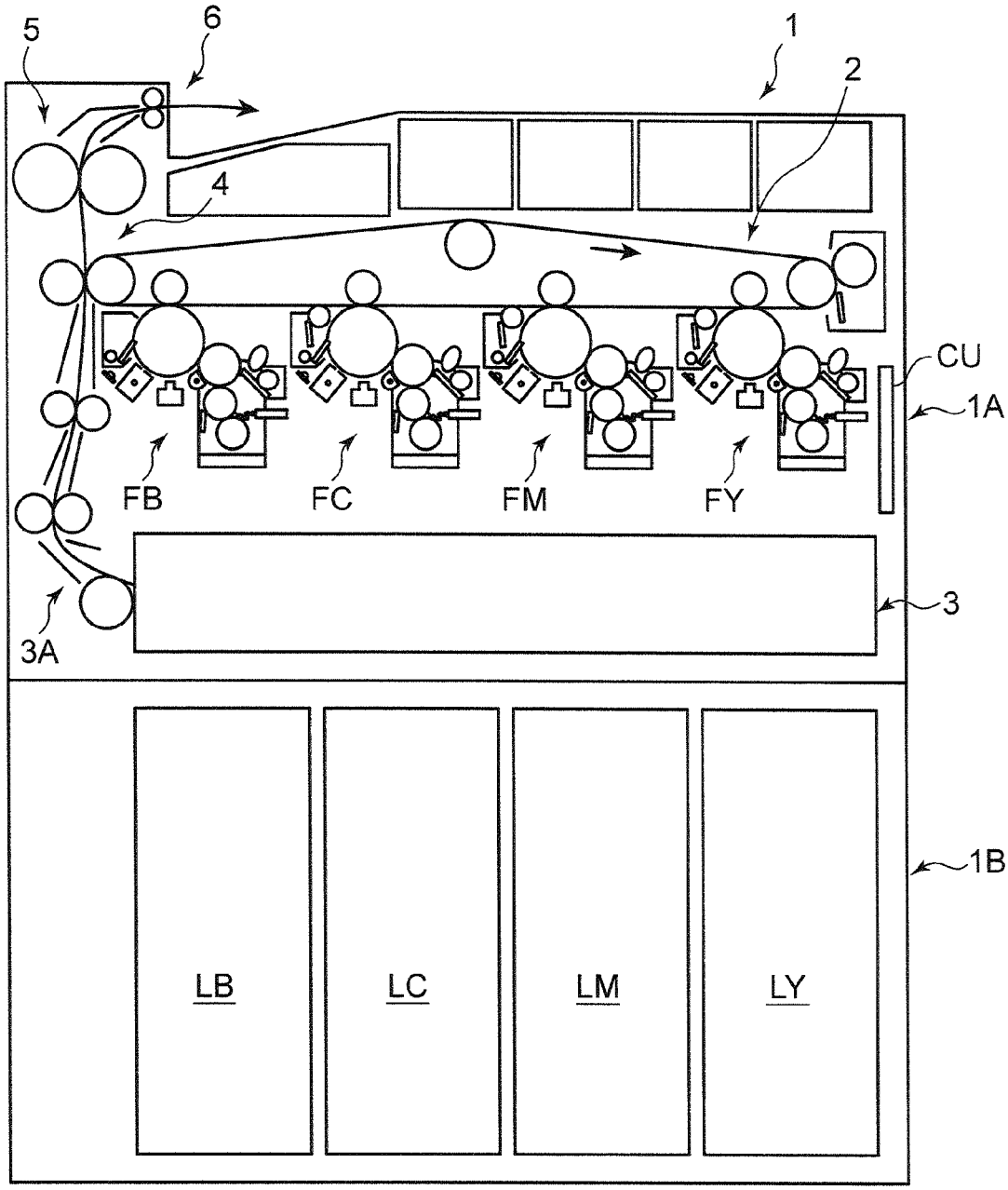
FIG. 1 is an overall schematic sectional view of a color printer (wet-type image forming apparatus) according to an embodiment of the disclosure.
Figure 2:
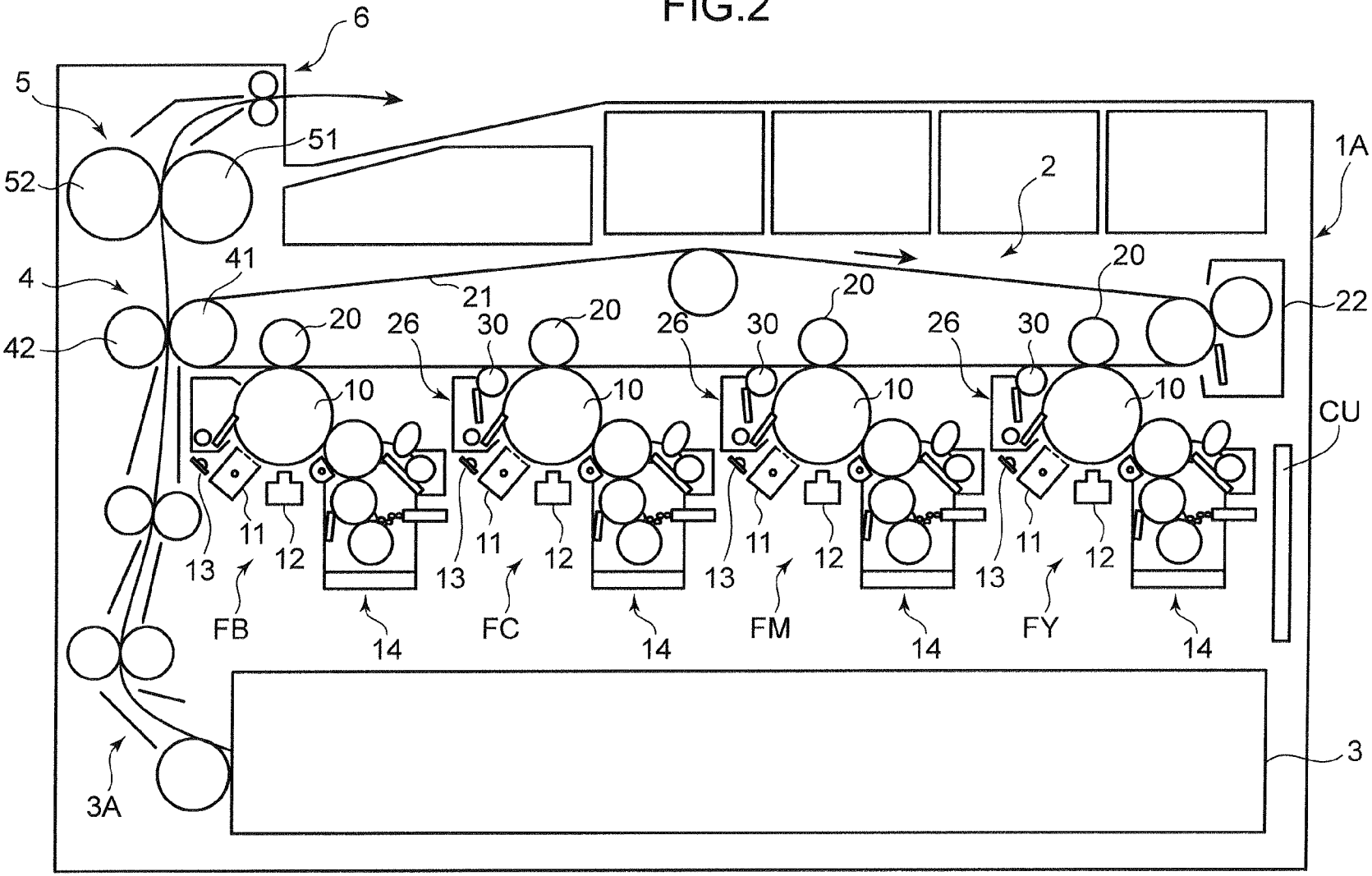
FIG. 2 is a schematic sectional view of the color printer excluding liquid developer recycling devices.

Hereinafter, an embodiment of the present disclosure is described in detail with reference to the drawings. FIG. 1 is an overall schematic sectional view of a color printer 1 (wet-type image forming apparatus) according to the embodiment of the present disclosure. FIG. 2 is a schematic construction diagram of the color printer 1 excluding liquid developer recycling devices. Note that although the wet-type image forming apparatus shown here is a color printer, it may be a copier, a facsimile machine, a complex machine (MFP) having these functions or another apparatus capable of forming an image on a sheet.

The color printer 1 includes an upper main body 1A housing various units and parts for image formation and a lower main body 1B arranged below the upper main body 1A and housing liquid developer recycling devices LY, LM, LC and LB for respective colors. Here, pipes connecting the upper and lower main bodies 1A, 1B are not shown.

The upper main body 1A includes a tandem image forming station 2 for forming a toner image based on image data, a sheet storage unit 3 for storing sheets, a secondary transfer unit 4 for transferring a toner image formed in the image forming station 2 to a sheet, a fixing unit 5 for fixing the transferred toner image to the sheet, a sheet discharge unit 6 for discharging the sheet finished with a fixing process, a sheet conveying unit 3A for conveying a sheet from the sheet storage unit 3 to the sheet discharge unit 6 and a controller unit CU composed of a control board mounted with electronic components for controlling various operations of the color printer 1.

The image forming station 2 includes an intermediate transfer belt 21, a cleaner 22 for the intermediate transfer belt and image forming units FY, FM, FC and FB corresponding to respective colors of yellow (Y), magenta (M), cyan (C) and black (Bk).

The intermediate transfer belt 21 is an endless, i.e. looped belt-like member having a conductive property and a width larger than usable largest sheets in a direction perpendicular to a sheet conveying direction, and is driven and rotated in a clockwise direction in FIGS. 1 and 2. Toner images respectively carried on photoconductive drums 10 to be described later are transferred to this intermediate transfer belt 21.

The four image forming units FY, FM, FC and FB are arranged side by side near the intermediate transfer belt 21 and between the cleaner 22 for the intermediate transfer belt 21 and the secondary transfer unit 4. Note that an arrangement order of the respective image forming units FY, FM, FC and FB is not limited to this, but this arrangement is preferable in view of influence of mixing of the respective colors on a complete image.

Each of the image forming units FY, FM, FC and FB includes the photoconductive drum 10 (image bearing member), a charger 11, an LED exposure device 12, a developing device 14, a primary transfer roller 20, a cleaner 26, a charge neutralizer 13 and a carrier liquid removing roller 30. Out of the image forming units, the image forming unit FB closest to the secondary transfer unit 4 does not include the carrier liquid removing roller 30, but the other construction thereof is identical.

The liquid developer recycling devices LY, LM, LC and LB are respectively provided in correspondence with the image forming units FY, FM, FC and FB to supply and collect the liquid developers of the respective colors. The liquid developer recycling devices LY, LM, LC and LB are described in detail later.

The photoconductive drum 10 is a cylindrical member and can bear a toner image containing charged toner (positively charged in this embodiment) on its surface. The photoconductive drum 10 is a member rotatable counterclockwise in FIGS. 1 and 2. The charger 11 is a device capable of uniformly charging the surface of the photoconductive drum 10. The exposure device 12 includes a light source such as an LED and irradiates the uniformly charged surface of the photoconductive drum 10 with light based on image data input from an external apparatus. In this way, an electrostatic latent image is formed on the surface of the photoconductive drum 10.

The developing device 14 supplies liquid developer containing toner and liquid carrier to the circumferential surface of the photoconductive drum 10. This causes the toner contained in the liquid developer to adhere to an electrostatic latent image carried on the circumferential surface of the photoconductive drum 10, whereby the electrostatic latent image is developed into a toner image. A detailed construction of this developing device 14 is described later with reference to FIGS. 3 and 4.

The primary transfer roller 20 is arranged at the inner side of the intermediate transfer belt 21 to face the photoconductive drum 10. A voltage having a polarity (negative polarity in this embodiment) opposite to the toner in the toner image is applied to the primary transfer roller 20 from an unillustrated power supply. That is, the primary transfer roller 20 applies a voltage having a polarity opposite to the toner to the intermediate transfer belt 21 at a position in contact with the intermediate transfer belt 21. Since the intermediate transfer belt 21 has a conductive property, the toner is attracted to the outer side of the intermediate transfer belt 21 and its surrounding by this voltage application. The intermediate transfer belt 21 functions as an image bearing member for bearing a toner image and conveying it to a sheet.

The cleaner 26 cleans the circumferential surface of the photoconductive drum 10 to remove the liquid developer remaining without being transferred from the photoconductive drum 10 to the intermediate transfer belt 21. The cleaner 26 includes a cleaning blade for scraping off the residual liquid developer on the surface of the photoconductive drum 10 and a liquid developer conveying screw for conveying the scraped-off residual liquid developer to the outside of the cleaner 26.

The charge neutralizer 13 includes a light source for charge neutralization and electrically neutralizes the surface of the photoconductive drum 10 by light from the light source in preparation for image formation by the next rotation after the liquid developer is removed by the cleaner 26.

The carrier liquid removing roller 30 is a substantially cylindrical member rotatable in the same direction as the photoconductive drum 10 about a rotation axis parallel with a rotation axis of the photoconductive drum 10. The carrier liquid removing roller 30 is arranged closer to the secondary transfer unit 4 than a contact position of the photoconductive drum 10 and the intermediate transfer belt 21 and removes the carrier liquid from the outer surface of the intermediate transfer belt 21.

The sheet storage unit 3 is for storing sheets to which toner images are to be fixed, and arranged in a lower part of the upper main body 1A. The sheet storage unit 3 includes a sheet cassette for storing the sheets.

The secondary transfer unit 4 is for transferring a toner image formed on the intermediate transfer belt 21 to a sheet and includes a supporting roller 41 for supporting the intermediate transfer belt 21 and a secondary transfer roller 42 arranged to face the supporting roller 41.

The fixing unit 5 is for fixing a toner image to a sheet and arranged above the secondary transfer unit 4. The fixing unit 5 includes a heating roller 51 and a pressure roller 52 arranged to face the heating roller 51.

The sheet discharge unit 6 is for discharging a sheet having a toner image fixed thereto in the fixing unit 5 and arranged in an upper part of the color printer 1. The sheet conveying unit 3A includes a plurality of conveyor roller pairs and conveys a sheet from the sheet storage unit 3 to the secondary transfer unit 4, the fixing unit 5 and the sheet discharge unit 6.

Figure 3:
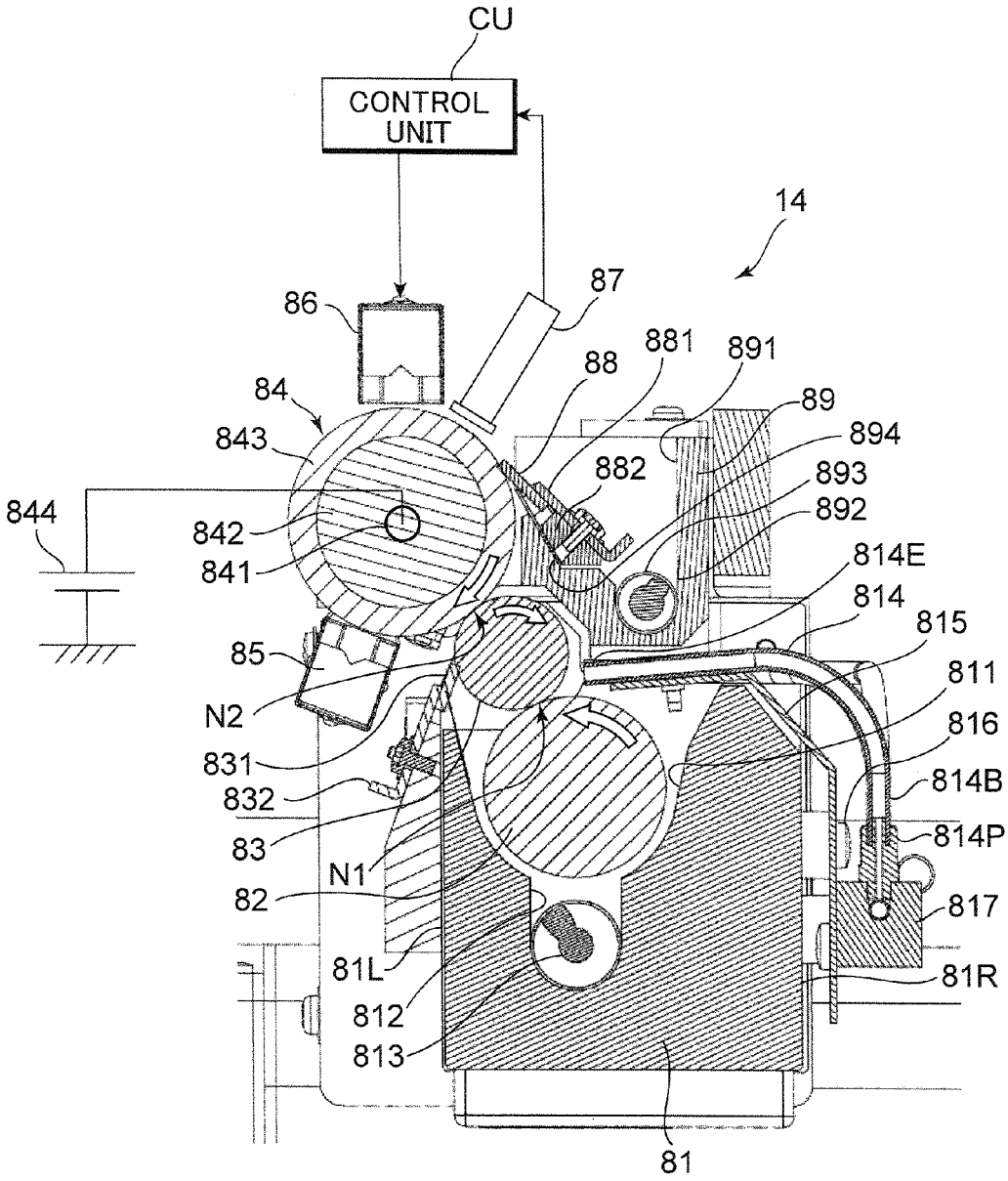
FIG. 3 is a sectional view showing a first embodiment of a developing device.

Next, the developing device 14 according to the first embodiment is described with reference to FIG. 3. The developing device 14 includes a developer container 81, a nip forming roller 82, a supply roller 83, a developing roller 84 (developer bearing member), a developing roller charger 85 (first charging unit), a developing roller neutralizer 86 (second charging unit), a surface electrometer 87 (measuring unit), a developing cleaning blade 88 (removing unit), a developer collecting container 89 and a control unit CU (controller).

The developer container 81 is a container shaped to be long in a direction along a rotation axis direction of the photoconductive drum 10 (direction perpendicular to the plane of FIG. 3) and adapted to receive the supply of the liquid developer containing toner particles and liquid carrier inside. The developer container 81 includes a first groove portion 811 and a second groove portion 812 which are open upward and narrowed in two stages. The first groove portion 811 located above is a cavity having a substantially semicircular cross section and extends in a longitudinal direction of the developer container 81. The nip forming roller 82 to be described later is rotatably accommodated in this first groove portion 811. The second groove portion 812 located below is a cavity having a substantially semicircular cross section, narrower than the first groove portion 811 and recessed downward from the bottom of the first groove portion 811, and likewise extends in the longitudinal direction of the developer container 81. A first conveying screw 813 is rotatably accommodated in this second groove portion 812.

Elbow-type supply nozzles 814 for supplying the liquid developer are attached to the developer container 81. The liquid developer is supplied to the support nozzles 814 with densities of the toner and carrier adjusted beforehand. A plurality of support nozzle 814 are arranged side by side in a rotation axis direction of the nip forming roller 33. Discharge ports 814E of the support nozzles 814 are ports through which the liquid developer is discharged, and arranged above the opening of the first groove portion 811. Further, base ends 814B of the support nozzles 814 are connected to connection plugs 814E. The support nozzles 814 are supported by a supporting frame 815 with the discharge ports 814E positioned.

The supporting frame 815 has an L-shaped cross section and supports the support nozzles 814 at its upper end side, and its lower end side is fixed to a right side wall 81R of the developer container 81 by a fixing screw 816. Further, a distributor 817 for distributing the liquid developer to the respective support nozzles 814 is attached to the right side wall 81R of the developer container 81, and a connection plug 814P is fitted into the distributor 817.

The nip forming roller 82 is a roller rotating about an axis parallel to the rotation axis of the photoconductive drum 10 and rotatably arranged in the first groove portion 811 of the developer container 81 as described above. The supply roller 83 is arranged not right above the nip forming roller 82, but obliquely upward in a direction away from the support nozzles 814, and grooves (not shown) for holding the liquid developer are formed on the circumferential surface thereof. The nip forming roller 82 is held in contact with the support roller 83 in such a manner as to support the support roller 83 from below, thereby forming a first nip portion N1. As shown by arrows in FIG. 3, the nip forming roller 82 rotates counterclockwise and the support roller 83 rotates clockwise.

The discharge ports 814E of the support nozzles 814 are arranged to face the first nip portion N1 and discharge the liquid developer toward the first nip portion N1. The liquid developer supplied from the support nozzles 814 is caused to temporarily stay at a side upstream of the first nip portion N1 in rotating directions and conveyed upward while being held in the grooves of the support roller 83 as the both rollers 82, 83 rotate. Note that excess liquid developer not conveyed by the support roller 83 drops into the developer container 81.

A support roller blade 831 made of a material such as urethane rubber is arranged at a side of the support roller 83 downstream of the first nip portion N1 in a rotating direction of the support roller 83. The support roller blade 831 is pressed into contact with the circumferential surface of the support roller 83 to restrict the amount of the liquid developer held on the support roller 83 to a predetermined amount. The support roller blade 831 is attached to a left side wall 81L of the developer container 81 while being held by a support fitting 832.

The excess liquid developer scraped off by the support roller blade 831 drops into the developer container 81. The dropped liquid developer is received by the second groove portion 812 via the wall surface of the first groove portion 811. Thereafter, the liquid developer is conveyed toward a collected developer tank 71 (FIG. 4) by the rotation of the first conveying screw 813.

The developing roller 84 is a roller for bearing the liquid developer on its circumferential surface and supplying the liquid developer to the photoconductive drum 10 to develop an electrostatic latent image carried on the photoconductive drum 10. The developing roller 84 is arranged to the left of and above the support roller 83 and held in contact with the support roller 83 to form a second nip portion N2. A roller structured such that an outer layer 843 made of conductive rubber (e.g. urethane) is provided on a conductive metal core 842 including rotary shafts 841 at both ends is used as the developing roller 84.

The developing roller 84 is rotated clockwise like the support roller 83 (the surface of the developing roller 84 moves in a direction opposite to the surface of the support roller 83 in the second nip portion N2), whereby the liquid developer held on the circumferential surface of the support roller 83 is transferred to the circumferential surface of the developing roller 84. Since layer thickness of the liquid developer on the support roller 83 is restricted to a predetermined value, that of the liquid developer layer formed on the developing roller 84 is kept at a predetermined value.

A developing bias is applied to the developing roller 84 from a bias applying device 844 (bias applying unit) via the rotary shafts 841. The developing roller 84 is in contact with the photoconductive drum 10 to form a nip portion between the developing roller 84 and the photoconductive drum 10. The toner moves to the circumferential surface of the photoconductive drum to develop an electrostatic latent image due to a potential difference between the potential of the electrostatic latent image on the circumferential surface of the photoconductive drum 10 and that of the developing bias applied to the developing roller 84. In this way, a toner image is formed on the circumferential surface of the photoconductive drum 10.

The developing roller charger 85 is arranged to improve development efficiency by giving a charge potential having the same polarity (positive polarity in this embodiment: first polarity) as the charge polarity of the toner to cause the toner in the developer layer carried on the developing roller 84 to move toward the surface of the developing roller 84. The developing roller charger 85 is arranged to face the circumferential surface of the developing roller 84 at a position downstream of the second nip portion N2 in a rotating direction of the developing roller 84 and upstream of a contact part with the photoconductive drum 10. A scorotron charger capable of suppressing charge nonuniformity is preferably used as this developing roller charger 85.

The developing roller neutralizer 86 reversely charges the toner in the residual developer remaining on the circumferential surface of the developing roller 84 to a charge potential having a polarity (negative polarity in this embodiment; second polarity) opposite to the charge potential given by the developing roller charger 85 after the development process of transferring the liquid developer to the photoconductive drum 10. The developing roller neutralizer 86 is arranged to face the circumferential surface of the developing roller 84 at a side downstream of the nip portion between the developing roller 84 and the photoconductive drum 10. A scorotron charger capable of suppressing charge nonuniformity is preferably used also as this developing roller neutralizer 86. An output of the developing roller neutralizer 86 is adjusted by the control unit CU.

Note that conductive charging rollers, charging films or corona dischargers other than scorotron chargers can also be used as the developing roller charger 85 and the developing roller neutralizer 86. However, the use of the scorotron charger as the developing roller neutralizer 86 is preferable since a pattern of the residual liquid developer that is not uniformly present on the circumferential surface of the developing roller 84 can be uniformly reversely charged.

The surface electrometer 87 is arranged between the developing roller neutralizer 86 and the developing cleaning blade 88 to be described later to measure the surface potential of the residual liquid developer. A measurement method for the surface potential may be a contact or non-contact measurement method and is not particularly limited to one method in the present disclosure. However, in view of developer contamination, the surface electrometer 87 adopting a non-contact measurement method is used in this embodiment. A surface electrometer Model 344 produced by Trek Japan can be, for example, suitably used as this surface electrometer 87.

The developing cleaning blade 88 removes the residual liquid developer from the circumferential surface of the developing roller 84 after the residual liquid developer is reversely charged (charging to the second polarity) by the developing roller neutralizer 86. The developing cleaning blade 88 is arranged downstream of the developing roller neutralizer 86 in the rotating direction of the developing roller 84 and a tip portion thereof is in contact with the circumferential surface of the developing roller 84 in a direction opposite to the rotating direction. The liquid developer remaining on the circumferential surface of the developing roller 84 is scraped off by a tip contact portion of the developing cleaning blade 88 as the developing roller 84 rotates.

The developer collecting container 89 is a container for collecting the liquid developer scraped off by the developing cleaning blade 88. The developer collecting container 89 includes a cavity 891 shaped to be long in the rotation axis direction of the photoconductive drum 10 and open upward. A groove portion 892 extending in a longitudinal direction of the developer collecting container 89 is formed at the bottom of this cavity 891. A second conveying screw 893 is rotatably accommodated in this groove portion 892. The scraped-off liquid developer flows down along the surface of the developing cleaning blade 88 and received by the groove portion 892 of the developer collecting container 89. Thereafter, the liquid developer is conveyed toward the collected developer tank 71 (FIG. 4) by the rotation of the second conveying screw 893.

Figure 4:
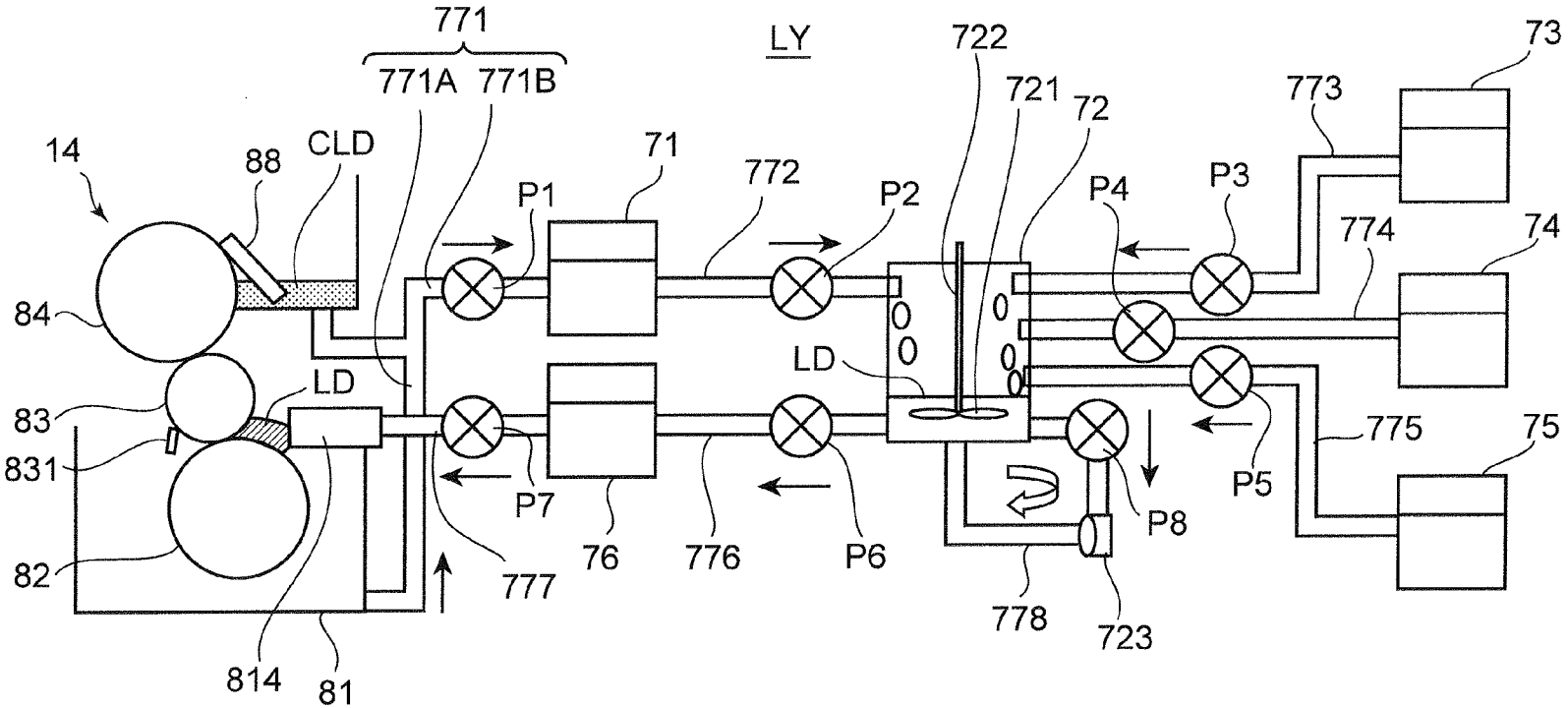
FIG. 4 is a construction diagram of the liquid developer recycling device.

Here, the supply of the liquid developer and a collecting system are described. FIG. 4 is a block diagram entirely and schematically showing one liquid developer recycling device LY. The other liquid developer recycling devices LM, LC and LB are identically constructed. This liquid developer recycling device LY is a device for supplying the liquid developer to the developing device 14 and recycling and reutilizing the liquid developer collected without being used for image development.

The liquid developer recycling device LY includes the collected developer tank 71, a developer storage container 72, a pigment tank 73, a binder resin tank 74, a carrier tank 75, a developer reserve tank 76 and a plurality of pumps P1 to P8.

The collected developer tank 71 is a tank connected to the developing device 14 via a first pipe 771 and capable of accommodating the liquid developer collected from the developing device 14. The first pipe 771 includes a first sub-pipe 771A connected to the developer container 81 and a second sub-pipe 771B connected to the developer collecting container 89. The first pump P1 is arranged at an intermediate position of the first pipe 771 and the residual liquid developer collected in the developer container 81 and the developer collecting container 89 is collected into the collected developer tank 71 via the first pipe 771 by driving the first pump P1.

The developer storage container 72 is connected to the collected developer tank 71. The developer storage container 72 is a container for preparing the liquid developer, the toner density of which is adjusted to a proper range, by adding toner (pigment), binder resin solution and carrier liquid to the collected residual liquid developer. The developer storage container 72 is connected to the collected developer tank 71 via a second pipe 772, and the second pump P2 is mounted in this second pipe 772. The liquid developer in the collected developer tank 71 is fed to the developer storage container 72 via a third pipe 773 by driving the second pump P2.

A liquid level detector including a rotating vane 721 and a drive shaft 722 for rotating the rotating vane 721 is arranged in the developer storage container 72 to detect the amount of the liquid developer. The rotating vane 721 is arranged to come into contact with liquid developer LD when the liquid level of the liquid developer LD in the developer storage container 72 reaches a predetermined height position or higher. The drive shaft 722 is driven and rotated by a motor (not shown) and the amount of the liquid developer is detected based on a load change or rotation speed change of the motor resulting from the contact of the rotating vane 721 with the liquid surface of the liquid developer.

A dispersion liquid of a pigment contributing to image formation of each color is contained in the pigment tank 73. Of course, a solution of toner in which a pigment is dispersed in binder resin beforehand may also be used, but a case where the pigment itself is used is illustrated in this embodiment. Conventionally known various organic and inorganic pigments for image formation can be used as this pigment. The dispersion liquid of the pigment contains a dispersion promoting agent for promoting dispersion of pigment particles in the liquid developer. In the present disclosure, liquid developer of a type in which a pigment is directly mixed can also be suitably used. "Toner" mentioned in this specification indicates so-called general toner and colored particles including pigments illustrated above.

An organic polymer compound solution containing components for fixing the pigment to a print sheet is contained in the binder resin tank 74. Cyclic olefin copolymer, styrene elastomer, ethyl cellulose, polyvinyl butyral or the like can be used as the organic polymer compound. This organic polymer compound is contained in the binder resin tank 74 in a state dissolved in an insulating organic solvent.

The carrier liquid is contained in the carrier tank 75. An electrical insulation organic solvent composed of aliphatic hydrocarbon liquid at normal temperature, vegetable oil and the like can be used as this carrier liquid. Note that the volume resistance of the carrier liquid is preferably $10^{12}$ Ω·cm or higher to improve a developing property.

The pigment tank 73 and the developer storage container 72 are connected by the third pipe 773, and the dispersion liquid of the pigment is supplied to the developer storage container 72 by driving the third pump P3 provided at an intermediate position of the third pipe 773. The binder resin tank 74 and the developer storage container 72 are connected by a fourth pipe 774, and the organic polymer compound solution is supplied to the developer storage container 72 by driving the fourth pump P4 provided at an intermediate position of the fourth pipe 774. The carrier tank 75 and the developer storage container 72 are connected by a fifth pipe 775, and the carrier liquid is supplied to the developer storage container 72 by driving the fifth pump P5 provided at an intermediate position of the fifth pipe 775.

The developer reserve tank 76 is a tank containing the liquid developer to be supplied to the developing device 14. The developer reserve tank 76 is connected to the developer storage container 72 by a sixth pipe 776 and receives the supply of the liquid developer from the developer storage container 72 by driving the sixth pump P6 provided at an intermediate position of the sixth pipe 776. Further, the developer reserve tank 76 is connected to the aforementioned supply nozzles 814, which supply the liquid developer into the developing device 14, by a seventh pipe 777, and the liquid developer is supplied by driving the seventh pump P7 mounted in the seventh pipe 777.

Toner density in the developer storage container 72 is adjusted based on a toner density detection result in a solid content density detector 723. A recycling path 778 whose entrance end and exit end are both connected to a bottom part of the developer storage container 72 is attached to the developer storage container 72. The solid content density detector 723 and the eighth pump P8 are mounted in this recycling path 778, the liquid developer is introduced into the solid content density detector 723 by driving the eighth pump P8, and the liquid developer is returned to the developer storage container 72 after the density thereof is measured. An unillustrated controller adjusts the toner (pigment) density of the liquid developer by appropriately driving the third to fifth pumps P3 to P5 based on the density measurement result of the solid content density detector 723.

Next, the control unit CU is described. The control unit CU includes a CPU (Central Processing Unit) for performing arithmetic processings and control processings, a ROM (Read Only Memory) storing various control programs and the like, a RAM (Random Access Memory) for temporarily storing data of arithmetic processings, control processings, etc. and the like. The control unit CU executes a control to reversely charge the residual liquid developer through the developing roller neutralizer 86 and adjusts an output of the developing roller neutralizer 86 according to the surface potential of the residual liquid developer measured by the surface electrometer 87 in addition to controlling various operations in the color printer 1.

The control unit CU adjusts the output of the developing roller neutralizer 86 using a surface potential $V_t$ of the toner related to a charge amount ρ of the toner as an index by the following equation (3).

$$V_t=1/(2\in_0\in_t)\times\rho d^2 \quad (3)$$

In the above equation (3), $\in_0$ denotes vacuum dielectric constant, $\in_1$ denotes specific dielectric constant of the toner, ρ denotes charge density of the developer and d denotes thickness of the liquid developer including the toner. When the toner is present on the circumferential surface of the developing roller 84 to which a developing bias $V_D$ is applied, the surface potential V of this liquid developer layer is calculated as follows.

$$V=V_D+V_t \quad (4)$$

Thus, $$V_t=V-V_D \quad (5)$$

This embodiment is characterized by charging (reversely charging) the toner in the liquid developer remaining on the developing roller 84 to a polarity opposite to the charge polarity given by the developing roller charger 85 in a proper range. As is clear from the above equations (4) and (5), when the toner is not reversely charged, the surface potential of the residual liquid developer is higher than the developing bias as a result of superimposition of the charge amount of the toner on the developing bias. However, when the toner is reversely charged, the surface potential of the residual liquid developer is lower than the developing bias. Accordingly, the charged state of the toner can be grasped by measuring the surface potential V by the surface electrometer 87.

As a result of studies by the present inventors, it was found out to be preferable in improving a property of cleaning the residual liquid developer by the developing cleaning blade 88 to reversely charge the toner by the developing roller neutralizer 86 so that the surface potential V of the residual liquid developer after reverse charging satisfies the following equation (1) when $V_D$ denotes the developing bias and $V_o$ denotes the surface potential of the residual liquid developer when the reverse charging is not performed.

$$0.1\leq(V_D-V)/(V_0-V_D)\leq1.0 \quad (1)$$

Generally, if it is aimed to neutralize the toner, the surface potential $V_t$ of the above equation (5) should be 0 V. However, the present inventors empirically found out that differently charged toner particles were mixedly present in the residual liquid developer in a state where the surface potential $V_t$ was near 0 V and the cleaning property was not good. They also found out that the surface potential V was preferably in the range of the above equation (1) to completely neutralize the toner unevenly present on the surface of the developing roller 84 by the developing roller charger 85 and disperse the toner more by an electric field.

The control unit CU sets the output of the developing roller neutralizer 86 in a range in which the surface potential V of the residual liquid developer satisfies the above equation (1). The output of the developing roller charger 85 largely varies depending on environment. This is because a ratio of a corona current flowing into the developing roller 84 and a ground circuit varies depending on external environment such as temperature and humidity, and how much the flowed-in electric charges are injected into the toner likewise varies due to temperature and humidity. Thus, it is preferable to adjust the output of the developing roller neutralizer 86 in accordance with an actual charged state. Accordingly, the control unit CU monitors the surface potential of the residual liquid developer based on the detection result of the surface electrometer 87 and adjusts the output of the developing roller neutralizer 86.

The control unit CU (image formation controller) adjusts the output of the developing roller neutralizer 86 during a predetermined adjustment period. This period is a period immediately after the color printer 1 is turned on, before or after an image forming process is started and between the feeds of sheets. At this time, the control unit CU causes a solid image to be formed on the circumferential surface of the photoconductive drum 10. That is, a plain electrostatic latent image is formed on the circumferential surface of the photoconductive drum 10 and developed with the liquid developer. The use of such a technique enables a patch layer of the residual liquid developer to be reliably formed on the developing roller 84 and is suitable for measurement of the surface potential, consequently precise output adjustment of the developing roller neutralizer 86.

Figure 5:
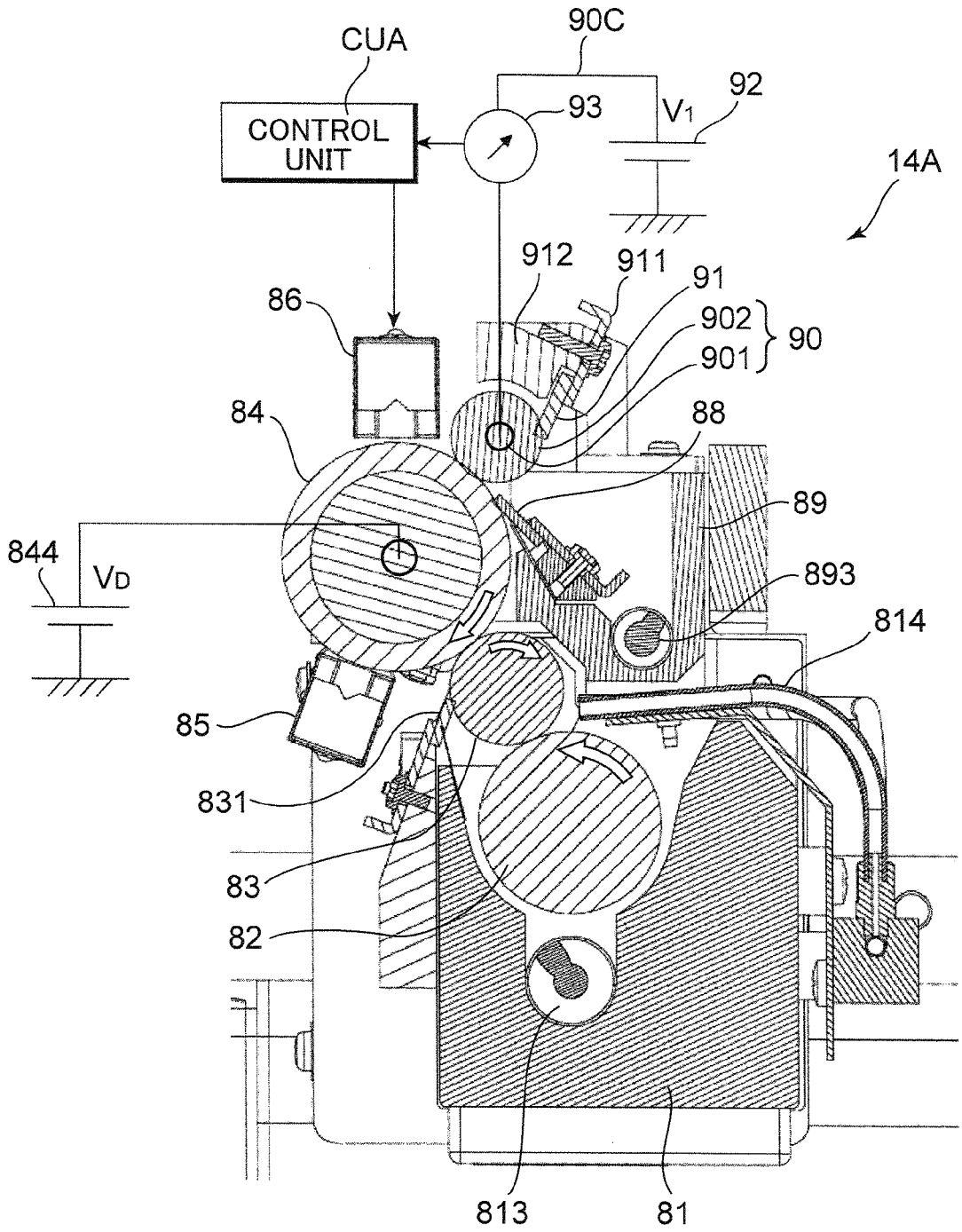
FIG. 5 is a sectional view showing a second embodiment of the developing device.

FIG. 5 is a sectional view showing a developing device 14A according to a second embodiment. This developing device 14A differs from the developing device 14 according to the first embodiment only in that a conductive roller 90 is used instead of the surface electrometer 87. The other parts are not described here since being the same as in the first embodiment. That is, the developing device 14A includes the construction of the developing device 14 excluding the surface electrometer 87, the conductive roller 90, a conductive roller blade 91, a voltage applying device 92 (voltage applying unit) and an ammeter 93 (current measuring unit).

The conductive roller 90 is arranged between a developing roller neutralizer 86 and a developing cleaning blade 88 and in contact with the circumferential surface of a developing roller 84 to form an electric path 90C extending from the circumferential surface of the developing roller 84 via a residual liquid developer layer to be grounded. The conductive roller 90 includes a rotary shaft 901 and a roller main body 902 integral to this rotary shaft and is rotated by the rotation of the developing roller 84. A material of the conductive roller 90 is not particularly limited, but it is preferable to use a low-resistance material to maximally increase a detection current. For example, a roller made of aluminum, copper, stainless steel or the like is suitably used as such. Of course, a rubber or resin roller in which a conductivity imparting agent is dispersed can also be used as the conductive roller 90.

The conductive roller blade 91 has the tip thereof arranged in contact with the circumferential surface of the conductive roller 90 to remove the residual liquid developer adhering to the circumferential surface of the conductive roller 90. The conductive roller blade 91 has a base end portion thereof held by a holder 911, which is fixed to a frame 912 supported and fixed on a developer collecting container 89. The residual liquid developer scraped off by the conductive roller blade 91 is collected into the developer collecting container 89.

The voltage applying device 92 applies a target voltage V1 to the rotary shaft 901 of the conductive roller 90. The target voltage V1 applied by the voltage applying device 92 is a voltage satisfying a relationship defined by the following equation (2).

$$0.1 \leq (V_D - V_1)/(V_0 - V_D) \leq 1.0 \quad (2)$$

The ammeter 93 measures a current flowing in the conductive roller 90. If the target voltage $V_1$ applied by the voltage applying device 92 and a surface potential V of the residual liquid developer on the developing roller 84 are equal, there is no potential difference between them, wherefore no current flows in the electric path 90C and a measurement value of the ammeter 93 is zero. On the other hand, if $V_1$ and V differ, the ammeter 93 measures a predetermined current value. Accordingly, if a desirable surface potential V is known, the surface potential V can be controlled substantially in the same manner as in the first embodiment by causing the voltage applying device 92 to apply a voltage equivalent to the desired surface potential V as the target voltage $V_1$ and adjusting the output of the developing roller neutralizer 86 so that the measurement value of the ammeter 93 is zero in this state.

Accordingly, a control unit CUA in the second embodiment sets the target voltage $V_1$ to a predetermined value and controls the output of the developing roller neutralizer 86 based on a measurement value of the ammeter 93. Specifically, the control unit CUA causes a solid image to be formed on the circumferential surface of the photoconductive drum 10 during a predetermined adjustment period and causes the voltage applying device 92 to apply the target voltage $V_1$ to the conductive roller 90. Then, the control unit CUA changes the output of the developing roller neutralizer 86 while monitoring the measurement value of the ammeter 93, searches an output value at which the measurement value of the ammeter 93 becomes zero and sets the output of the developing roller neutralizer 86 to this output value.

Figure 6:
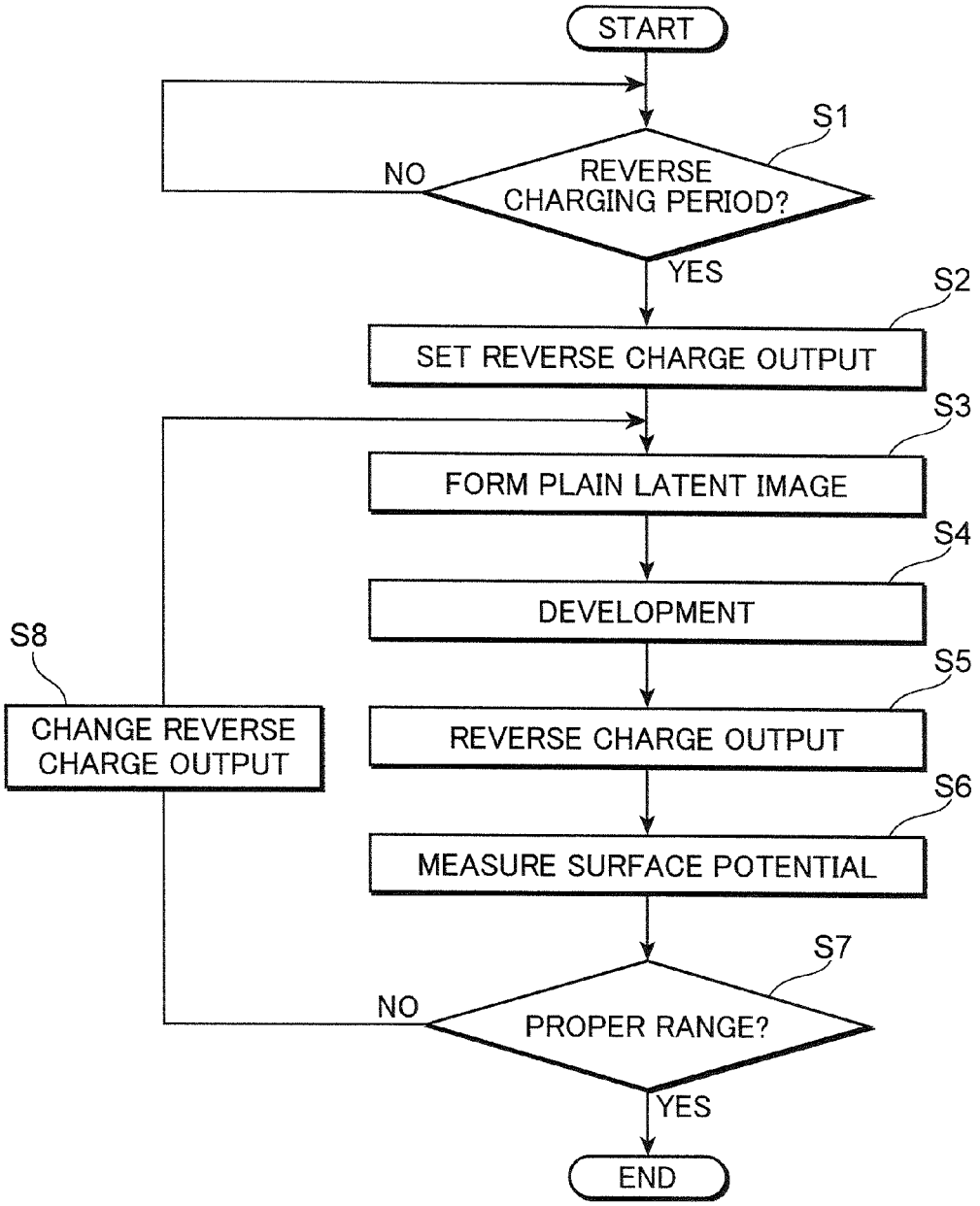
FIG. 6 is a flow chart showing the operation of a reverse charging process according to the first embodiment.

FIG. 6 is a flow chart showing an operation of adjusting a reverse charge output by the control unit CU when the developing device 14 of the first embodiment is used. The control unit CU confirms whether or not a predetermined reverse charging adjustment period is in process (Step S1) and sets the output of the developing roller neutralizer 86 to the predetermined value (Step S2) if the adjustment period is in process (YES in Step S1).

Subsequently, the control unit CU causes a plain electrostatic latent image to be formed on the circumferential surface of the photoconductive drum 10 (Step S3) and causes the developing device 14 to develop this electrostatic latent image with the liquid developer (Step S4). Thereafter, the control unit CU operates the developing roller neutralizer 86 with the output set in Step S2, thereby reversely charging the toner in the residual liquid developer on the developing roller 84 (Step S5).

Thereafter, the control unit CU obtains the value of the surface potential V of the residual liquid developer measured by the surface electrometer 87 (Step S6) and, then, determines whether or not the obtained surface potential V belongs to the proper range satisfying the above equation (1) (Step S7). If it is in the proper range (YES in Step S7), a process of adjusting the reverse charge output is finished. On the other hand, unless it is in the proper range (NO in Step S7), an output set value of the developing roller neutralizer 86 is changed (Step S8) and a return is made to Step S3 to repeat the process.

Figure 7:
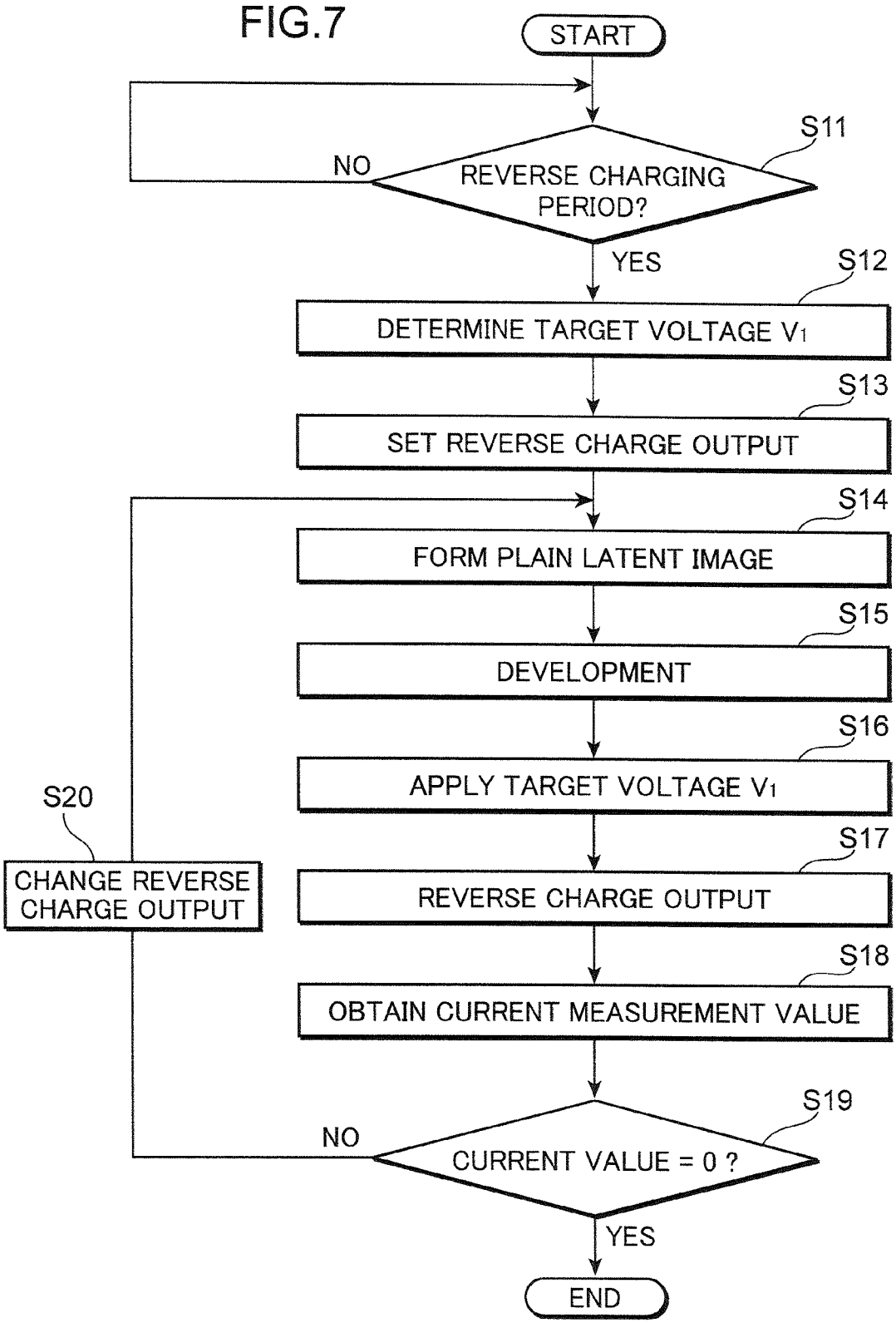
FIG. 7 is a flow chart showing the operation of a reverse charging process according to the second embodiment.

FIG. 7 is a flow chart showing an operation of adjusting a reverse charge output by the control unit CUA when the developing device 14A of the second embodiment is used. The control unit CUA confirms whether or not a predetermined reverse charging adjustment period is in process (Step S11), and determines the target voltage $V_1$ to be applied by the voltage applying device 92 (Step S12) and sets the output of the developing roller neutralizer 86 to the predetermined value (Step S13) if the adjustment period is in process (YES in Step S11).

Subsequently, the control unit CUA causes a plain electrostatic latent image to be formed on the circumferential surface of the photoconductive drum 10 (Step S14) and causes the developing device 14A to develop this electrostatic latent image with the liquid developer (Step S15). Thereafter, the control unit CUA operates the developing roller neutralizer 86 with the output set in Step S13, thereby reversely charging the toner in the residual liquid developer on the developing roller 84 (Step S17).

Thereafter, the control unit CUA obtains a current measurement value of the electric path 90C measured by the ammeter (Step S18) and, then, determines whether or not the obtained current value is zero (Step S19). If the current value=0 (YES in Step S19), a process of adjusting the reverse charge output is finished. On the other hand, unless the current value=0 (NO in Step S19), an output set value of the developing roller neutralizer 86 is changed (Step S20) and a return is made to Step S14 to repeat the process.

Example

Liquid Developer

Liquid developer containing a cyan pigment, a binder resin using a styrene elastomer and carrier liquid was produced under the following conditions. A resin solution was obtained by dissolving 1.33 parts by mass of styrene-butadiene elastomer ("Asaprene (trademark) T-413" produced by Asahi Kasei Chemicals Corporation: styrene content of 30 mass %) in 98.67 parts by mass of vegetable oil (medium chain triglyceride "Coconade MT" produced by Kao Corporation) as a solvent. On the other hand, a pigment dispersion was obtained by mixing and dispersing 72 parts by mass of liquid paraffin ("Moresco White P-200" produced by Moresco Corporation) as carrier liquid, 20 parts by mass of cyan pigment (C. I. Pigment blue 15:3) as colored particles and 8 parts by mass of "Antaron (trademark) V-216" produced by ISP as a dispersion stabilizer for 1 hour at a drive frequency of 60 Hz using a rocking mill (RM-10 produced by Seiwa Giken Co., Ltd.). An average particle diameter (D50) of the pigment in the pigment dispersion was 0.5 p.m. By mixing the resin solution and the pigment dispersion at a mixing ratio (mass ratio) of 3:1, cyan liquid developer containing 5 parts by mass of pigment and 1 part by mass of styrene elastomer was produced.

<Image Forming Apparatus>

The color printer 1 having the construction shown in FIGS. 1 and 2 was used as an image forming apparatus. On the other hand, the developing device 14 including the surface electrometer 87 and shown in FIG. 3 (example, comparative examples 1a to 1i, 1A to 1I; see Tables 1 and 2 below) and the developing device 14A including the conductive roller 90 and shown in FIG. 5 (example, comparative examples 2a to 2i, 2A to 2I; see Tables 3 and 4 below) were used as a developing device.

<Evaluation>

Process conditions were; a linear velocity of 0.1 m/sec, a developing bias of 300 V and a photoconductor surface potential of 450 V. After a plain image pattern was printed on a white sheet A4, a toner pattern of the developing cleaning blade 88 held in contact with the developing roller 84 was picked up using a tape. A tainted degree FD (optical density) of the picked-up pattern was evaluated by a reflection densitometer SPECTROEYE produced by Gretag Macbeth to obtain the value of FD. The output of the developing roller charger 85 was set at two values; 4 kV (example, comparative examples 1a to 1i, 2a to 2i; see Tables 1 and 3 below) and 5 kV (example, comparative examples 1A to 1I, 2A to 2I; see Tables 2 and 4 below).

<Results>

Under the above conditions, the output of the developing roller neutralizer 86 was changed by changing the surface potential V in the example and comparative examples 1a to 1i, 1A to 1I (Tables 1 and 2 below) and changing the target voltage $V_1$ in the example and comparative examples 2a to 2i, 2A to 2I. Then, FD was obtained under the respective conditions and evaluated in three levels.

○: 0.00≤FD≤0.010

Δ: 0.010≤FD≤0.015 x: 0.015<FD

Figure 8:
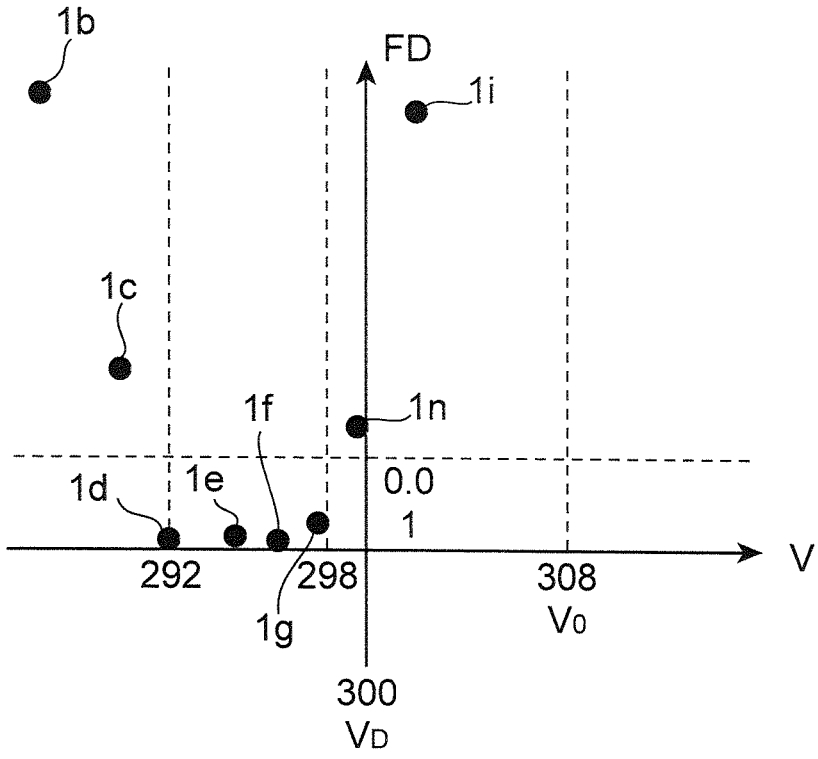
FIG. 8 is a graph showing a relationship between optical density and surface potential.

Of course, ○ indicates satisfactory. These results are shown in Table 1 to Table 4. The respective Tables include the value of $(V_D-V)/(V_0-V_D)$ or $(V_D-V_1)/(V_0-V_D)$. Note that FIG. 8 shows a relationship between FD and V in the example and comparative examples 1b to 1i.

TABLE 1

| | C. Exa 1a | C. Exa 1b | C. Exa 1c | Exa 1d | Exa 1e | Exa 1f | Exa 1g | C. Exa 1h | C. Exa 1i |
|---|---|---|---|---|---|---|---|---|---|
| Charger (kV) | 4 | 4 | 4 | 4 | 4 | 4 | 4 | 4 | 4 |
| $V_0$ | 308 | 308 | 308 | 308 | 308 | 308 | 308 | 308 | 308 |
| $V_D$ | 300 | 300 | 300 | 300 | 300 | 300 | 300 | 300 | 300 |
| V | 286 | 288 | 290 | 292 | 294 | 296 | 298 | 300 | 302 |
| $V_0-V_D$ | 8 | 8 | 8 | 8 | 8 | 8 | 8 | 8 | 8 |
| $V-V_D$ | −14 | −12 | −10 | −8 | −6 | −4 | −2 | 0 | 2 |
| $(V_D-V)/(V_0-V_D)$ | 1.8 | 1.5 | 1.3 | 1.0 | 0.8 | 0.5 | 0.3 | 0 | −0.3 |
| Determination of FD | x | x | x | ○ | ○ | ○ | ○ | Δ | x |

TABLE 2

| | C. Exa 1A | Exa 1B | Exa 1C | Exa 1D | Exa 1E | Exa 1F | Exa 1G | C. Exa 1H | C. Exa 1I |
|---|---|---|---|---|---|---|---|---|---|
| Charger (kV) | 5 | 5 | 5 | 5 | 5 | 5 | 5 | 5 | 5 |
| $V_0$ | 312 | 312 | 312 | 312 | 312 | 312 | 312 | 312 | 312 |
| $V_D$ | 300 | 300 | 300 | 300 | 300 | 300 | 300 | 300 | 300 |
| V | 286 | 288 | 290 | 292 | 294 | 296 | 298 | 300 | 302 |
| $V_0-V_D$ | 12 | 12 | 12 | 12 | 12 | 12 | 12 | 12 | 12 |
| $V-V_D$ | −14 | −12 | −10 | −8 | −6 | −4 | −2 | 0 | 2 |
| $(V_D-V)/(V_0-V_D)$ | 1.2 | 1.0 | 0.8 | 0.7 | 0.5 | 0.3 | 0.2 | 0 | −0.2 |
| Determination of FD | x | ○ | ○ | ○ | ○ | ○ | ○ | Δ | x |

TABLE 3

| | C. Exa 2a | C. Exa 2b | C. Exa 2c | Exa 2d | Exa 2e | Exa 2f | Exa 2g | C. Exa 2h | C. Exa 2i |
|---|---|---|---|---|---|---|---|---|---|
| Charger (kV) | 4 | 4 | 4 | 4 | 4 | 4 | 4 | 4 | 4 |
| $V_0$ | 308 | 308 | 308 | 308 | 308 | 308 | 308 | 308 | 308 |
| $V_D$ | 300 | 300 | 300 | 300 | 300 | 300 | 300 | 300 | 300 |
| V | 286 | 288 | 290 | 292 | 294 | 296 | 298 | 300 | 302 |
| $V_0-V_D$ | 8 | 8 | 8 | 8 | 8 | 8 | 8 | 8 | 8 |

TABLE 3-continued

| | C. Exa 2a | C. Exa 2b | C. Exa 2c | Exa 2d | Exa 2e | Exa 2f | Exa 2g | C. Exa 2h | C. Exa 2i |
|---|---|---|---|---|---|---|---|---|---|
| $V_1 - V_D$ | −14 | −12 | −10 | −8 | −6 | −4 | −2 | 0 | 2 |
| $(V_D - V_1)/(V_0 - V_D)$ | 1.8 | 1.5 | 1.3 | 1.0 | 0.8 | 0.5 | 0.3 | 0 | −0.3 |
| Determination of FD | x | x | Δ | ○ | ○ | ○ | ○ | x | x |

TABLE 4

| | C. Exa 2A | Exa 2B | Exa 2C | Exa 2D | Exa 2E | Exa 2F | Exa 2G | C. Exa 2H | C. Exa 2I |
|---|---|---|---|---|---|---|---|---|---|
| Charger (kV) | 5 | 5 | 5 | 5 | 5 | 5 | 5 | 5 | 5 |
| $V_0$ | 312 | 312 | 312 | 312 | 312 | 312 | 312 | 312 | 312 |
| $V_D$ | 300 | 300 | 300 | 300 | 300 | 300 | 300 | 300 | 300 |
| V | 286 | 288 | 290 | 292 | 294 | 296 | 298 | 300 | 302 |
| $V_0 - V_D$ | 12 | 12 | 12 | 12 | 12 | 12 | 12 | 12 | 12 |
| $V - V_D$ | −14 | −12 | −10 | −8 | −6 | −4 | −2 | 0 | 2 |
| $(V_D - V_1)/(V_0 - V_D)$ | 1.2 | 1.0 | 0.8 | 0.7 | 0.5 | 0.3 | 0.2 | 0 | −0.2 |
| Determination of FD | x | ○ | ○ | ○ | ○ | ○ | ○ | x | x |

From the above results, the property of cleaning the circumferential surface of the developing roller 84 by the developing cleaning blade 88 was confirmed to be improved by adjusting the surface potential of the residual liquid developer after reverse charging so as to satisfy the range of $0.1 \leq (V_D - V)/(V_0 - V_D) \leq 1.0$ or $0.1 \leq (V_D - V_1)/(V_0 - V_D) \leq 1.0$.

As described above, according to the wet-type image forming apparatus of the present disclosure, the surface potential V of the residual liquid developer can be set to the second polarity opposite to the first polarity at the time of the development process. If charge neutralization is performed for the purpose of releasing cohesive force of the toner as in the conventional technology, it is expected to set the surface potential of the residual liquid developer to zero. However, the present inventors found out that, when the surface potential was set at zero, the residual liquid developer was actually in such a state where differently charged toner particles were mixedly present and the cleaning property by the removing unit could not be improved, and that the toner charged to the first polarity and unevenly present on the surface of the developer bearing member before the development process only had to be reversely charged such that the surface potential V lies in the range defined by the above equation (1) to completely neutralize the toner and disperse the toner in the residual liquid developer.

According to the present disclosure, the residual developer remaining on the surface of the developer bearing member after the development process is precisely removed. Therefore, it is possible to provide a wet-type image forming apparatus capable of stably forming high-quality images over a long period of time.

This application is based on Japanese Patent application No. 2010-278257 filed in Japan Patent Office on Dec. 14, 2010, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A wet-type image forming apparatus, comprising:

an image bearing member for bearing an electrostatic latent image and a toner image on the circumferential surface thereof;

a developer bearing member for bearing liquid developer containing toner and carrier liquid on the circumferential surface thereof and supplying the liquid developer to the image bearing member to develop the electrostatic latent image;

a bias applying unit for applying a developing bias to the developer bearing member;

a first charging unit for charging the toner in the liquid developer to a first polarity before a development process of supplying the liquid developer to the image bearing member;

a second charging unit for reversely charging the toner in residual liquid developer remaining on the circumferential surface of the developer bearing member to a second polarity opposite to the first polarity after the development process; and a removing unit for removing the residual liquid developer from the circumferential surface of the developer bearing member after charging to the second polarity;

wherein a surface potential V of the residual liquid developer after the reverse charging satisfies the following equation (1) when $V_D$ denotes the developing bias and $V_0$ denotes the surface potential of the residual liquid developer when the reverse charging is not performed:

$$0.1 \leq (V_D - V)/(V_0 - V_D) \leq 1.0 \quad (1).$$

2. A wet-type image forming apparatus according to claim 1, wherein:

the developer bearing member is a developing roller which rotates about an axis; and the second charging unit and the removing unit are arranged to face the circumferential surface of the developing roller and the removing unit is arranged downstream of the second charging unit in a rotating direction of the developing roller.

3. A wet-type image forming apparatus according to claim 1, further comprising a controller for adjusting an output of the second charging unit.

4. A wet-type image forming apparatus according to claim 3, further comprising a measuring unit arranged between the second charging unit and the removing unit for measuring the surface potential of the residual liquid developer, wherein the controller adjusts the output of the second charging unit according to an output of the measuring unit.

5. A wet-type image forming apparatus according to claim 3, further comprising:

a conductive roller arranged in contact with the circumferential surface of the developer bearing member between the second charging unit and the removing unit;

a voltage applying unit for applying a voltage $V_1$ satisfying the following equation (2) to the conductive roller; and a current measuring unit for measuring a current flowing in the conductive roller;

wherein the controller adjusts the output of the second charging unit so that a current measurement value of the current measuring unit approaches zero:

$$0.1 \leq (V_D - V_1)/(V_0 - V_D) \leq 1.0 \quad (2).$$

6. A wet-type image forming apparatus according to claim 4, further comprising an image formation controller for executing a control to form the electrostatic latent image on the image bearing member, wherein the image formation controller causes a plain electrostatic latent image to be formed on the image bearing member during a predetermined adjustment period.

7. A wet-type image forming apparatus according to claim 1, wherein the second charging unit is a scorotron charger.

* * * * *